US010858862B2

(12) United States Patent
Seacat et al.

(10) Patent No.: US 10,858,862 B2
(45) Date of Patent: Dec. 8, 2020

(54) LOCKSET WITH POWERED RETRACTION

(71) Applicant: Schlage Lock Company LLC, Carmel, IN (US)

(72) Inventors: Justin D. Seacat, Carmel, IN (US); Matthew Brandes, Port Washington, NY (US); Avi Gordon, Meadowbrook, PA (US); Matthew Heacock, Annapolis, MD (US); Brendan Szuwalski, Dallas, TX (US)

(73) Assignee: Schlage Lock Company LLC, Carmel, IN (US)

( * ) Notice: Subject to any disclaimer, the term of this patent is extended or adjusted under 35 U.S.C. 154(b) by 181 days.

(21) Appl. No.: 16/185,548

(22) Filed: Nov. 9, 2018

(65) Prior Publication Data

US 2020/0149317 A1 May 14, 2020

(51) Int. Cl.

| | |
|---|---|
| ***E05B 47/00*** | (2006.01) |
| ***E05B 59/00*** | (2006.01) |
| ***E05B 15/02*** | (2006.01) |
| ***E05B 9/02*** | (2006.01) |

(52) U.S. Cl.

CPC ..... *E05B 47/0001* (2013.01); *E05B 9/02* (2013.01); *E05B 15/02* (2013.01); *E05B 59/00* (2013.01); *E05B 47/0012* (2013.01); *E05B 2047/002* (2013.01); *E05B 2047/0057* (2013.01); *E05Y 2900/132* (2013.01)

(58) Field of Classification Search

CPC ..... E05B 47/0001; E05B 59/00; E05B 15/02; E05B 9/02; E05B 2047/002; E05B 2047/0057; E05B 47/0012; E05B 2047/0021; E05B 2047/0022; E05B 63/14; E05Y 2900/132

USPC ..... 70/277, 278.1–278.3, 278.7, 279.1, 70/280–282, 283.1, DIG. 3, DIG. 42, 70/107–111, 190, 191; 292/DIG. 62, 142, 292/144, 39, 51, 160, 172, 199

See application file for complete search history.

(56) References Cited

U.S. PATENT DOCUMENTS

| | | | | |
|---|---|---|---|---|
| 4,606,203 | A | 8/1986 | Esser | |
| 4,833,465 | A * | 5/1989 | Abend | E05B 47/0012 340/5.65 |
| 6,585,302 | B2 * | 7/2003 | Lin | E05B 47/0012 292/142 |
| 7,363,784 | B2 | 4/2008 | Shvarts | |
| 7,364,212 | B1 * | 4/2008 | Fan | E05B 1/003 292/33 |
| 7,856,856 | B2 | 12/2010 | Shvartz | |

(Continued)

*Primary Examiner* — Lloyd A Gall

(74) *Attorney, Agent, or Firm* — Taft Stettinius & Hollister LLP

(57) ABSTRACT

An exemplary lockset includes a first bolt, a second bolt, and a drive assembly operable to retract the first bolt and the second bolt. The drive assembly includes a first gear train including a first input gear and a first output gear operably connected with the first bolt, a second gear train including a second input gear and a second output gear operably connected with the second bolt, a third input gear, and an electromechanical driver operable to rotate the third input gear in an unlocking direction. The third input gear is engaged with the first input gear and the second input gear such that rotation of the third input gear in the unlocking direction causes rotation of the first and second output gears, thereby retracting the first and second bolts.

20 Claims, 8 Drawing Sheets

(56) References Cited

U.S. PATENT DOCUMENTS

| | | | | |
|---|---|---|---|---|
| 8,056,941 | B2 | 11/2011 | Segev et al. | |
| 9,416,567 | B2 * | 8/2016 | Ji | E05C 1/08 |
| 2002/0084656 | A1 * | 7/2002 | Lin | E05B 47/0012 292/160 |
| 2002/0095958 | A1 | 7/2002 | Bates et al. | |
| 2003/0121301 | A1 * | 7/2003 | Warmack | E05B 47/0012 70/257 |
| 2014/0077675 | A1 | 3/2014 | Liang et al. | |

* cited by examiner

LOCKSET WITH POWERED RETRACTION

TECHNICAL FIELD

The present disclosure generally relates to electromechanical locksets, and more particularly but not exclusively relates to interconnected tubular locksets.

BACKGROUND

Certain existing electronic locksets are configured to permit retraction of a latchbolt and/or a deadbolt in response to presentation of an authorized credential. Many existing locksets suffer from a variety of drawbacks and limitations. For example, certain existing locksets require that the user manually retract the latchbolt and/or the deadbolt even after presenting an authorized credential. This process can be inconvenient, particularly when the user is carrying one or more objects that occupy the use of his or her hands. For these reasons among others, there remains a need for further improvements in this technological field.

SUMMARY

An exemplary lockset includes a first bolt, a second bolt, and a drive assembly operable to retract the first bolt and the second bolt. The drive assembly includes a first gear train including a first input gear and a first output gear operably connected with the first bolt, a second gear train including a second input gear and a second output gear operably connected with the second bolt, a third input gear, and an electromechanical driver operable to rotate the third input gear in an unlocking direction. The third input gear is engaged with the first input gear and the second input gear such that rotation of the third input gear in the unlocking direction causes rotation of the first and second output gears, thereby retracting the first and second bolts. Further embodiments, forms, features, and aspects of the present application shall become apparent from the description and figures provided herewith.

DETAILED DESCRIPTION OF ILLUSTRATIVE EMBODIMENTS

Figure 1:
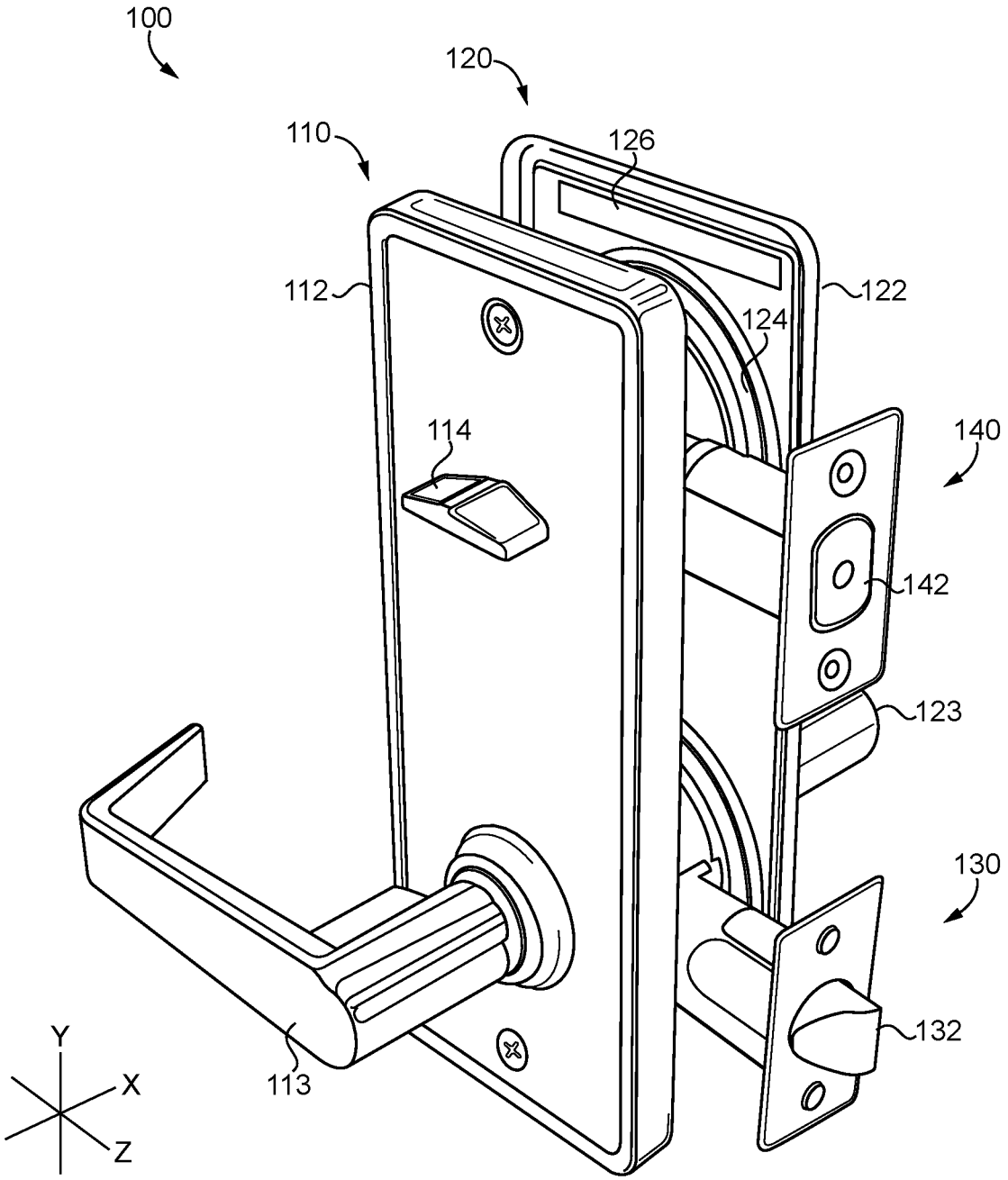
FIG. 1 is a perspective view of a lockset according to certain embodiments.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

As used herein, the terms "longitudinal," "lateral," and "transverse" are used to denote motion or spacing along three mutually perpendicular axes, wherein each of the axes defines two opposite directions. The directions defined by each axis may be referred to as positive and negative directions, wherein the arrow of the axis indicates the positive direction. In the coordinate system illustrated in FIG. 1, the X-axis defines the longitudinal directions, the Y-axis defines the lateral directions, and the Z-axis defines the transverse directions. These terms are used for ease and convenience of description, and are without regard to the orientation of the system with respect to the environment. For example, descriptions that reference a longitudinal direction may be equally applicable to a vertical direction, a horizontal direction, or an off-axis orientation with respect to the environment.

Furthermore, motion or spacing along a direction defined by one of the axes need not preclude motion or spacing along a direction defined by another of the axes. For example, elements which are described as being "laterally offset" from one another may also be offset in the longitudinal and/or transverse directions, or may be aligned in the longitudinal and/or transverse directions. The terms are therefore not to be construed as limiting the scope of the subject matter described herein.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

With reference to FIG. 1, illustrated therein is a lockset 100 according to certain embodiments. The lockset 100 generally includes an inside assembly 110 configured for mounting to the interior or secured side of a door, an outside assembly 120 configured for mounting to the exterior or unsecured side of the door, a latchbolt assembly 130 configured for mounting in a first set of bores in the door, and a deadbolt assembly 140 configured for mounting in a second set of bores in the door. The latchbolt assembly 130 includes a latchbolt 132 having an extended latching position and a retracted unlatching position, and is spring-biased toward the extended latching position. The deadbolt assembly 140 includes a deadbolt 142 having an extended locking position and a retracted unlocking position.

The inside assembly 110 generally includes an inside escutcheon 112, an inside handle 113 pivotably mounted to the escutcheon 112, and a thumbturn 114 rotatably mounted to the escutcheon 112. The handle 113 is operably connected with the latchbolt assembly 130 such that rotation of the handle 113 from a home position to a pivoted position causes the latchbolt 132 to retract. The thumbturn 114 is operably connected with the deadbolt assembly 140 such that rotation of the thumbturn 114 in opposite directions causes the deadbolt 142 to extend and retract. As described herein, the inside assembly 110 further includes a drive assembly 200 operable to electromechanically retract the latchbolt 132 and the deadbolt 142, and a controller 116 that controls operation of the drive assembly 200.

The outside assembly 120 generally includes an outside escutcheon 122 and an outside handle 123 pivotably mounted to the escutcheon 122, and may further include a lock cylinder 124 mounted to the escutcheon 122. The handle 123 is operably connected with the latchbolt assembly 130 such that rotation of the handle 123 from a home position to a pivoted position causes the latchbolt 132 to retract. The lock cylinder 124 is operably connected with the deadbolt assembly 140 such that actuation of the lock cylinder 124 with an appropriate key causes the deadbolt 142 to extend and retract.

The outside assembly 120 further includes a credential reader 126 operable to read a user credential. In certain forms, the user credential may be embodied on a card or chip, such as a magnetic card, radio frequency identification (RFID) circuitry, a near field communication (NFC) card, or an ultra-wideband (UWB) communication device, and the credential reader 126 may be configured to read such user credentials. Additionally or alternatively, the user credential may be stored on a mobile device configured to transmit the user credential to the credential reader 126. In certain embodiments, the credential reader 126 may be a biometric credential reader such as a fingerprint scanner or an iris recognition device, and the user credential may be a corresponding biometric credential. In other forms, the credential reader 126 may comprise a keypad and the user may input a user credential in the form of a personal identification number or a password using the keypad. While certain examples have been given for the credential reader 126 and the credential, it is to be appreciated that such examples are illustrative only and are non-limiting in nature.

Figure 2:
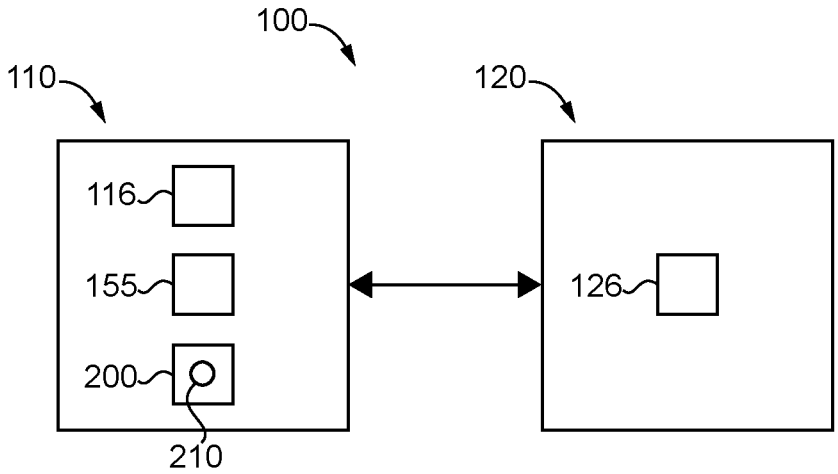
FIG. 2 is a schematic block diagram of a system according to certain embodiments.

With additional reference to FIG. 2, the credential reader 126 is in communication with the controller 116, which analyzes information received from the credential reader 126 and determines whether the user credential read by the credential reader 126 is authorized to operate the lockset 100. If so, the controller 116 actuates the drive assembly 200, which retracts the latchbolt 132 and the deadbolt 142 to allow for push/pull operation of the door. Further details regarding the actuation of the drive assembly 200 are provided below.

Figure 3:
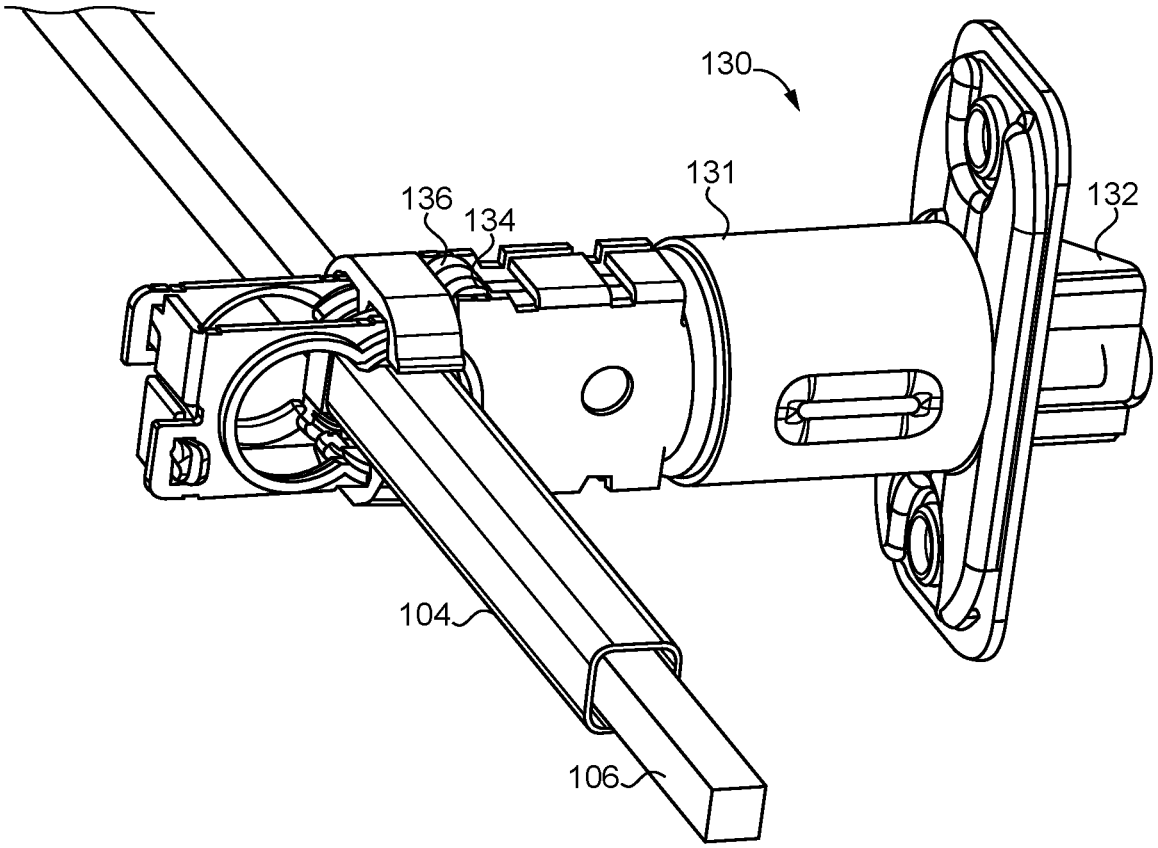
FIG. 3 is a perspective view of a latchbolt assembly according to certain embodiments.

With additional reference to FIG. 3, the latchbolt assembly 130 further includes a housing 131 in which the latchbolt 132 is slidably mounted, a first retractor 134 rotatably mounted in the housing 131, and a second retractor 136 rotatably mounted in the housing 131. Each of the retractors 134, 136 is engaged with the latchbolt 132 and is independently operable to cause retraction of the latchbolt 132 when the retractor 134/136 is rotated. The lockset 100 further includes an outer spindle 104 and an inner spindle 106 mounted within and extending through the outer spindle 104. The outer spindle 104 is engaged with the drive assembly 200 and the first retractor 134 such that rotation of the outer spindle 104 by the drive assembly 200 causes rotation of the first retractor 134 and a corresponding retraction of the latchbolt 132. The inner spindle 106 is engaged with each of the handles 113, 123 and the second retractor 136 such that rotation of either handle 113/123 causes rotation of the second retractor 136 and a corresponding retraction of the latchbolt 132. In the illustrated embodiment, the spindles 104, 106 are rotationally decoupled and are thereby rotatable relative to one another.

Figure 4:
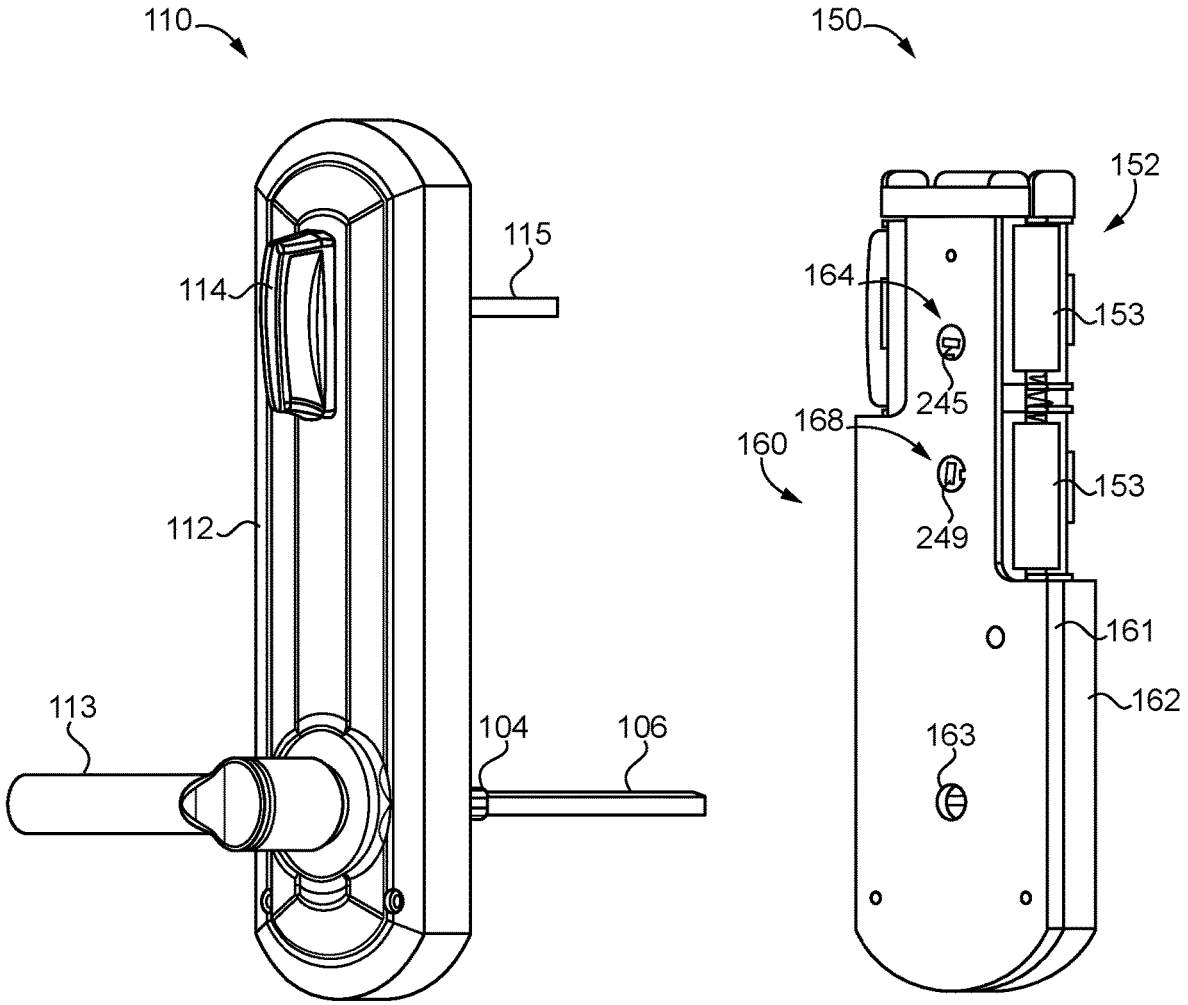
FIG. 4 is a partially-exploded illustration of an inside assembly including a lock control module according to certain embodiments.

With additional reference to FIG. 4, the inside assembly 110 further includes a modular lock control unit or lock control module 150 that includes the drive assembly 200 and the controller 116. The lock control module 150 is sized and shaped to fit in the escutcheon 112, and interfaces with the outer spindle 104 and the tailpiece 115 of the thumbturn 114 to provide for electronic retraction of the latchbolt 132 and the deadbolt 142. As described herein, the outer spindle 104 extends through the lock control module 150 and engages the drive assembly 200 and the latchbolt assembly 130 such that the drive assembly 200 is operable to rotate the spindle 104 to retract the latchbolt 132. Similarly, the tailpiece 115 extends through the lock control module 150 and engages the drive assembly 200 and the deadbolt assembly 140 such that the drive assembly 200 is operable to rotate the tailpiece 115 to retract the deadbolt 142.

In the illustrated form, the lock control module 150 includes an energy storage device housing 152 in electrical communication with the controller 116, and may further include one or more energy storage devices 153 operable to supply power to the controller 116 and to the drive assembly 200. It is also contemplated that the lock control module 150 may be configured for connection to line power or to a wireless power transmission device, in which case the energy storage device housing 152 and the energy storage devices 153 may be omitted. In embodiments that include the energy storage devices 153, the energy storage devices 153 may, for example, be provided in the form of batteries or super-capacitors.

The lock control module 150 further includes a housing assembly 160, which includes a first case member 161 and a second case member 162 coupled to the first case member 161 such that a cavity 169 (FIG. 5) is defined by and between the case members 161, 162. The housing assembly 160 defines a first opening 163 and a second opening 164, and in the illustrated embodiment further defines a third opening 168. Each of the openings 163, 164, 168 extends through each of the case members 161, 162 such that each of the openings 163, 164, 168 is defined in part by the first case member 161 and is defined in part by the second case member 162. As described herein, the outer spindle 104 extends through the housing assembly 160 via the first opening 163, and the tailpiece 115 extends through the housing assembly 160 via the second opening 164. The tailpiece 115 is also operable to extend through the housing assembly 160 via the third opening 168.

Figure 5:
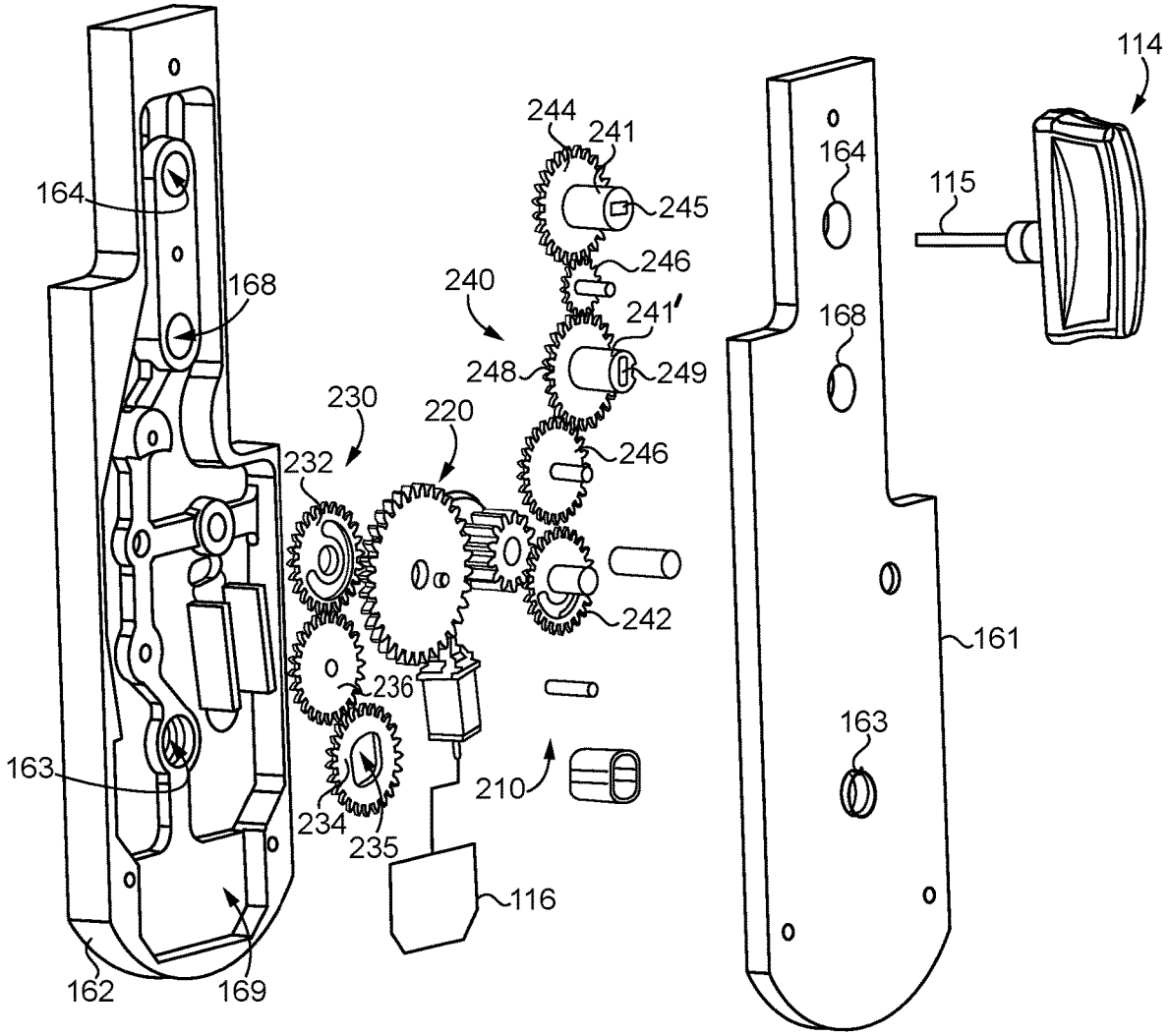
FIG. 5 is an exploded assembly view of the lock control assembly illustrated in FIG. 4, which includes a drive assembly according to certain embodiments.

With additional reference to FIG. 5, the drive assembly 200 is housed within the housing assembly 160, and generally includes a driver 210 in communication with the controller 116, an input gear train 220 connected to the driver 210, a latchbolt gear train 230 connected between the latchbolt assembly 130 and the input gear train 220, and a deadbolt gear train 240 connected between the deadbolt assembly 140 and the input gear train 220. As described herein, the driver 210 is configured to rotate the input gear train 220, which simultaneously rotates the latchbolt gear train 230 and the deadbolt gear train 240 to actuate the latchbolt assembly 130 and the deadbolt assembly 140, thereby providing for contemporaneous retraction of the latchbolt 132 and the deadbolt 142. The drive assembly 200 further includes a lost motion assembly that enables manual actuation of the deadbolt assembly 140 by the thumbturn 114 without causing movement of the latchbolt gear train 230.

Figure 6:
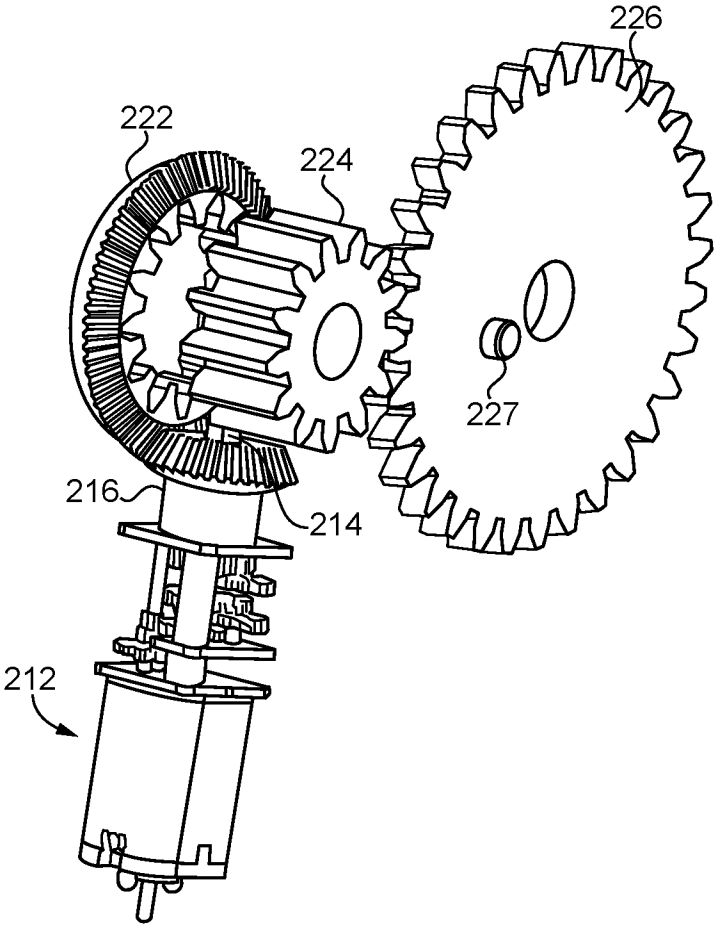
FIG. 6 is a partially-exploded view of a portion of the drive assembly illustrated in FIG. 5.

With additional reference to FIG. 6, the driver 210 generally includes a rotary motor 212 in communication with the controller 116, a motor shaft 214 operable to be rotated by the motor 212, and a first bevel gear 216 mounted to the shaft 214. The input gear train 220 includes a second bevel gear 222 meshed with the first bevel gear 216, a pinion gear 224 mounted to the second bevel gear 222, and an additional gear 226 meshed with the pinion gear 224. The additional gear 226 is engaged with input gears 232, 242 of the latchbolt gear train 230 and the deadbolt gear train 240 such that the gear 226 is operable to rotate the first and second input gears 232, 242, and may be referred to as the third input gear 226. The motor 212 is controlled by the controller 116 such that the controller 116 is operable to drive the motor 212 to rotate the input gear 226 in each of a locking direction and an unlocking direction.

Figure 7:
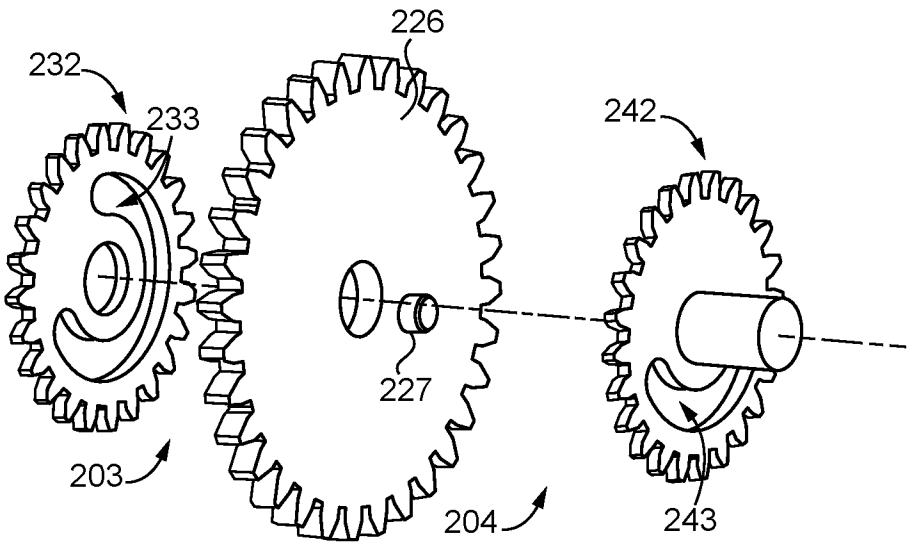
FIG. 7 is an exploded assembly view of another portion of the drive assembly illustrated in FIG. 5.

With additional reference to FIG. 7, the input gear 226 is connected to a latchbolt input gear 232 via a first lost motion connection 203, and is connected to a deadbolt input gear 242 via a second lost motion connection 204. The latchbolt input gear 232 includes an aperture in the form of an arcuate slot 233, which partially defines the first lost motion connection 203. The deadbolt input gear 242 also includes an aperture in the form of an arcuate slot 243, which partially defines the second lost motion connection 204. The input gear 226 includes a post 227 that extends through the gear 226 and defines protrusions on opposite sides of the gear. The input gears 226, 232, 242 are coaxially mounted, and each protrusion is received in a corresponding one of the slots 233, 243 to further define the lost motion connections 203, 204. Further details regarding the lost motion connections 203, 204 and the functions thereof are provided below.

Figure 8:
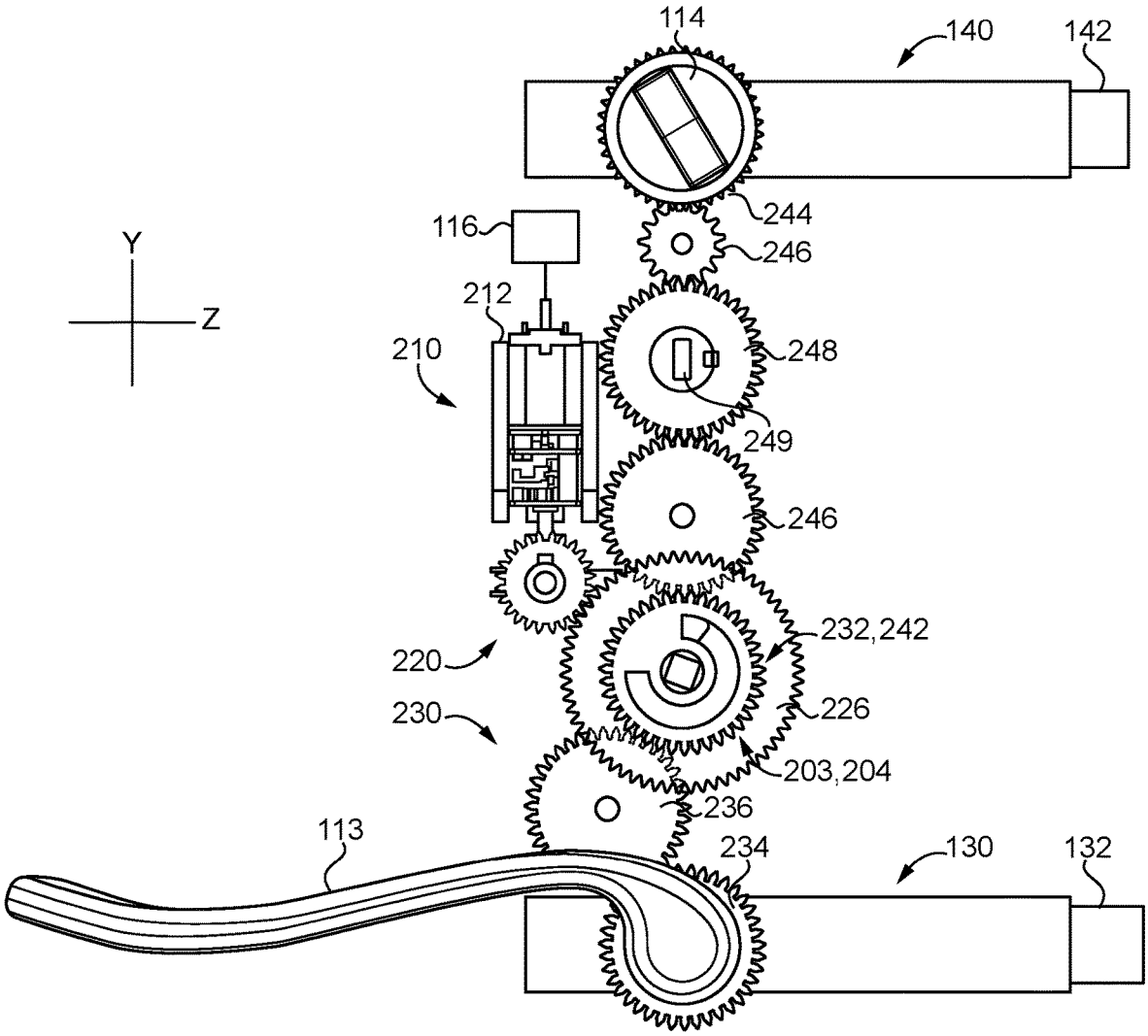
FIG. 8 is a plan view of the drive assembly illustrated in FIG. 5.

With additional reference to FIG. 8, the latchbolt gear train 230 includes the latchbolt input gear 232 and a latchbolt output gear 234, and may further include one or more intermediate gears 236. The latchbolt output gear 234 includes an engagement feature 235 that is aligned with the first opening 163 in the housing assembly 160. The engagement feature 235 is sized and shaped to engage the outer spindle 104 such that rotation of the output gear 234 in a latchbolt-retracting direction rotates the spindle 104, thereby retracting the latchbolt 132. As noted above, the latchbolt input gear 232 is connected with the input gear 226 via the lost motion connection 203. The lost motion connection 203 is configured such that when the input gear 226 is driven by the motor 212 in the unlocking direction, the latchbolt input gear 232 also rotates in the unlocking direction. This rotation of the latchbolt input gear 232 is transmitted to the latchbolt output gear 234 to rotate the output gear 234 in the latchbolt-retracting direction, thereby causing electronic retraction of the latchbolt 132.

When the handle 113 is rotated manually for manual retraction of the latchbolt 132, such rotation may be transferred to latchbolt output gear 234 via the spindle 106. As noted above, the outer spindle 104, which is rotationally coupled to the latchbolt output gear 234, is rotationally decoupled from the inner spindle 106, which is rotationally coupled with the inside handle 113. As a result, rotation of the inner spindle 106 is not transmitted to the outer spindle 104, and the latchbolt 132 can be manually retracted by operating the handle 113 without causing a corresponding rotation of the latchbolt gear train 230. Similarly, electronic retraction of the latchbolt 132 by rotation of the latchbolt gear train 230 is effected without causing a corresponding rotation of the handle 113.

The deadbolt gear train 240 includes the deadbolt input gear 242 and a deadbolt output gear 244, and may further include one or more intermediate gears 246. The deadbolt output gear 244 includes an engagement feature 245 that is aligned with the second opening 164 in the housing assembly 160. In the illustrated form, the engagement feature 245 is provided in the form of a slot 245 that extends through a post 241, which is rotationally coupled with the deadbolt output gear 244. The thumbturn 114 includes a tailpiece 115 (FIG. 5) that extends through the post 241 and engages the deadbolt assembly 140 such that rotation of the tailpiece 115 in opposite directions causes the deadbolt 142 to extend and retract. As a result, the thumbturn 114 is rotationally coupled with the deadbolt output gear 244 such that rotation of the output gear 244 in a deadbolt-retracting direction causes retraction of the deadbolt 142 and rotation of the output gear 244 in an opposite deadbolt-extending direction causes extension of the deadbolt 142.

As noted above, the deadbolt input gear 242 is connected with the input gear 226 via the lost motion connection 204. The lost motion connection 204 is configured such that when the input gear 226 is driven by the motor 212 in the unlocking direction, the deadbolt input gear 242 also rotates in the unlocking direction. This rotation of the deadbolt input gear 242 is transmitted to the deadbolt output gear 244 to rotate the output gear 244 in the deadbolt-retracting direction, thereby causing electronic retraction of the deadbolt 142.

When the thumbturn 114 is rotated manually for manual retraction of the deadbolt 142, such rotation is transferred to the deadbolt output gear 244 via the tailpiece 115. As will be appreciated, such rotation of the deadbolt output gear 244 in the deadbolt-retracting direction causes a corresponding rotation of the deadbolt input gear 242 in the unlocking direction. Due to the lost motion connection 204, however, such rotation is not transmitted to the input gear 226. Instead, such rotational motion is lost as a result of the arcuate slot 243, which permits the deadbolt input gear 242 to rotate relative to the input gear 226 without causing a corresponding rotation of the input gear 226. As a result, manual retraction of the deadbolt 142 by the thumbturn 114 does not back-drive the motor 212 or cause rotation of the latchbolt gear train 230. Thus, the deadbolt 142 can be manually retracted while the latchbolt 132 remains extended.

In the illustrated embodiment, the deadbolt gear train 240 further includes a second deadbolt output gear 248, which is offset from the first deadbolt output gear 244 in the lateral direction and is substantially similar to the first deadbolt output gear 244. In particular, the second deadbolt output gear 248 is configured to rotate in the deadbolt-retracting direction in response to rotation of the input gear 226 in the unlocking direction. Additionally, the second deadbolt output gear 248 includes an engagement feature 249 formed in a post 241', which respectively correspond to the engagement feature 245 and the post 241. The engagement feature 249 is aligned with the third opening 168 in the housing assembly 160 such that the tailpiece 115 is operable to pass through the third opening 168 while engaging the engagement feature 249. When so engaged, the tailpiece 115 can be rotated by the second deadbolt output gear 248 to retract the deadbolt 142. Thus, while the thumbturn 114 is illustrated as being mounted to the first deadbolt output gear 244, the thumbturn 114 can also be mounted to the second deadbolt output gear 248.

The alternative mounting locations for the thumbturn 114 facilitate installation of the lockset 100 in door preparations of different configurations. In the United States, for example, it is typical for door preparations to have one of two standard offset distances between the latchbolt bore and the deadbolt bore. The offset distance between the latchbolt output gear 234 and the upper deadbolt output gear 244 is selected such that installation in door preparations having the greater offset can be accommodated by mounting the thumbturn 114 to the upper or first deadbolt output gear 244. Similarly, the offset distance between the latchbolt output gear 234 and the lower deadbolt output gear 248 is selected such that installation in door preparations having the lesser offset can be accommodated by mounting the thumbturn 114 to the lower or second deadbolt output gear 248. Alternatively, the thumbturn 114 may remain mounted to the upper deadbolt output gear 244, and a connector may be mounted to the lower deadbolt gear 248. In such forms, the connector extends into the door and engages the deadbolt mechanism 140 such that rotation of the lower deadbolt gear 248 causes movement of the deadbolt 142.

Figure 9:
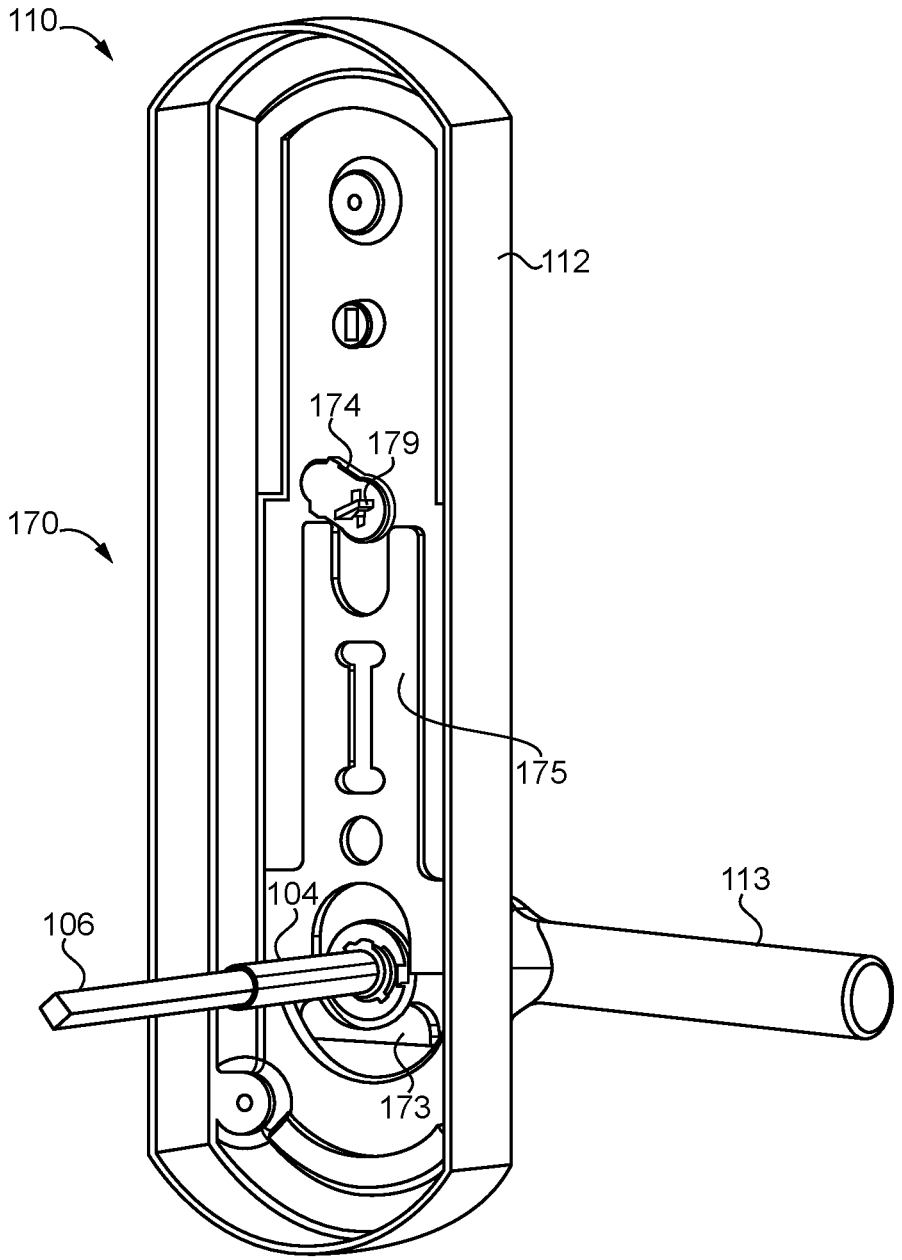
FIG. 9 is a perspective view of an interconnect mechanism according to certain embodiments.

With additional reference to FIG. 9, the inside assembly 110 further includes an interconnect mechanism 170 that provides for simultaneous retraction of the latchbolt 132 and the deadbolt 142 when the handle 113 is operated to retract the latchbolt 132. The interconnect mechanism 170 includes a first cam 173 mounted for rotation with the handle 113, a second cam 174 rotatably mounted to the escutcheon 112, and a slide 175 slidably mounted to the escutcheon 112 between the cams 173, 174. The second cam 174 includes a protrusion 179 that engages the engagement feature 249 such that the second cam 174 is rotationally coupled with the second deadbolt output gear 248. Upon full assembly of the lock, the slide 175 is pressed between the escutcheon and the inner case, which retains the alignment of the slide 175.

When the handle 113 is rotated to retract the latchbolt 132, the first cam 173 drives the slide 175 laterally upward, thereby driving the second cam 174 to rotate in the deadbolt-retracting direction. Such rotation of the second cam 174 causes a corresponding rotation of the second deadbolt output gear 248, which causes the deadbolt gear train 240 to rotate the first deadbolt output gear 244 in the deadbolt retracting direction. As a result, manual retraction of the latchbolt 132 by operation of the handle 113 causes a contemporaneous retraction of the deadbolt 142, despite the presence of the lost motion connections 203, 204.

During typical operation, the lockset 100 may be placed in a locked state by rotating the thumbturn 114 or actuating the lock cylinder 124 to extend the deadbolt 142 while the door is in the closed position. In this state, rotation of the outside handle 123 may serve to retract the latchbolt 132, but the deadbolt 142 remains extended to retain the door in the closed position. The inside spindle 106 is connected with the inside handle 113 and the outside handle 123 via lost motion connections or slip connections such that rotation of either handle 113/123 does not rotate the other handle 113/123. As a result, rotation of the outside handle 123 does not actuate the interconnect mechanism 170, and the deadbolt 142 remains in the extended position.

When a user approaches the door from the unsecured side, the user may present a credential to the credential reader 126, for example by scanning a card or mobile device, inputting a personal identification number (PIN), or presenting a biometric credential. The credential reader 126 transmits credential information to the controller 116, which determines whether the credential information relates to an authorized credential.

In response to determining that the presented credential is an authorized credential, the controller 116 transmits an actuating signal to the motor 212, which causes the driver 210 to rotate the input gear 226 in the unlocking direction. The actuating signal may, for example, be provided in the form of power of a first polarity that is transmitted from the energy storage device 153 via the controller 116. In certain forms, the actuating signal may be provided in the form of a series of electrical pulses, for example in embodiments in which the motor 212 is provided in the form of a stepper motor.

Rotation of the input gear 226 in the unlocking direction causes a corresponding rotation of the coaxially-mounted latchbolt input gear 232, thereby causing rotation of the latchbolt output gear 234 in the latchbolt-retracting direction. Rotation of the input gear 226 in the unlocking direction also causes a corresponding rotation of the coaxially-mounted deadbolt input gear 242, thereby causing rotation of the deadbolt output gear 244 in the deadbolt-retracting direction. Thus, presentation of a valid credential to the credential reader 126 causes hands-free retraction of the latchbolt 132 and the deadbolt 142, thereby allowing the user to conveniently open the door even when his or her hands are otherwise occupied.

Once the latchbolt 132 and the deadbolt 142 have been retracted, the controller 116 may transmit a hold signal operative to retain the driver 210 in its current position, thereby maintaining the latchbolt 132 in its retracted position against the internal biasing force of the latchbolt assembly 130, which biases the latchbolt 132 toward its extended position. As a result, the latchbolt 132 remains retracted for the duration of the hold signal. After a predetermined period of time, the controller 116 may terminate the hold signal to allow the latchbolt 132 to return to its extended position. Alternatively, the controller 116 may transmit the hold signal until a door position sensor indicates that the door has been moved to the open position, and thereafter terminate transmission of the hold signal. In such forms, the latchbolt 132 may return to the extended position upon opening of the door such that a subsequent closing movement of the door causes the door to become latched in the closed position.

In certain forms, the controller 116 may further be operable to transmit a relock signal. For example, the outside assembly 120 may have mounted thereon a relock button that causes the controller 116 to transmit the relock signal. In response to receiving the relock signal, the driver 210 may operate to rotate the input gear 226 in a direction that causes the deadbolt output gear 244 to rotate in a deadbolt-extending direction opposite the deadbolt-retracting direction. Due to the configuration of the lost motion connections 203, 204, such rotation is not transmitted to the latchbolt gear train 230. In such forms, the deadbolt 142 may be electronically extended without causing a corresponding actuation of the latchbolt gear train 230.

As should be evident from the foregoing, the lock control module 150, when installed to the lockset 100, provides for convenient operation of the lockset 100, and may further facilitate installation of the lockset 100 in different door preparations by providing distinct locations at which the thumbturn 114 and the deadbolt assembly 140 can be installed. The illustrated lock control module 150 may further facilitate installation in at least one other manner.

It is common for locksets such as the lockset 100 to be installed to a door in either a right-hand orientation or a left-hand orientation. As will be appreciated, the latchbolt-retracting direction for the latchbolt output gear 234 and the deadbolt-retracting direction for the deadbolt output gear 244 depends upon the orientation of the lockset 100. More particularly, the retracting directions in the left-hand orientation are opposite of the retracting directions in the right-hand orientation. To accommodate these different retracting directions, the lock control module 150 is reversible. More particularly, the lock control module 150 can be rotated 180° about its lateral vertical axis to reverse the direction in which the output gears 234, 244 rotate in response to rotation of the input gear 226 in the unlocking direction. Thus, a single lock control module 150 can be utilized in both right-handed installations and left-handed installations.

In the illustrated embodiment, the lockset 100 includes first and second bolt assemblies in the form of a latchbolt assembly 130 and a deadbolt assembly 140. As such, the first and second bolts of the illustrated lockset 100 are provided in the form of a spring-biased latchbolt 132 and a deadlocking deadbolt 142. It is also contemplated that first and second bolts may be provided in another form, such as two latchbolts or two deadbolts. Furthermore, while only two bolts are illustrated, it is to be appreciated that additional or alternative bolts may be utilized. By way of example, the lockset 100 may include a second deadbolt assembly 140, which may be connected with the second deadbolt output gear 244 such that actuation of the deadbolt gear train 240 causes retraction of both deadbolts.

Additionally, while each of the illustrated gear trains 230, 240 is composed of spur gears that mesh with one another, it is also contemplated one or both of the gear trains 230, 240 may take a different form. As one example, two or more of the illustrated spur gears may be replaced with sprockets that are connected to one another by a chain. By way of example, the gear train 240 may include an input sprocket in place of the input gear 242 and an output sprocket in place of the output gear 244, and the intermediate gear(s) 246 may be omitted in favor of a chain that operably connects the input sprocket and the output sprocket.

Furthermore, while the illustrated driver 210 includes a single motor 212 that actuates both gear trains 230, 240, it is also contemplated that the driver 210 may include plural motors that operate in tandem. By way of example, the driver 210 may include a first motor that actuates the first gear train 230 and a second motor that actuates the second gear train 240. In such forms, the motors may operate contemporaneously to retract the latchbolt 132 and the deadbolt 142 based upon signals received from the controller 116.

Figure 10:
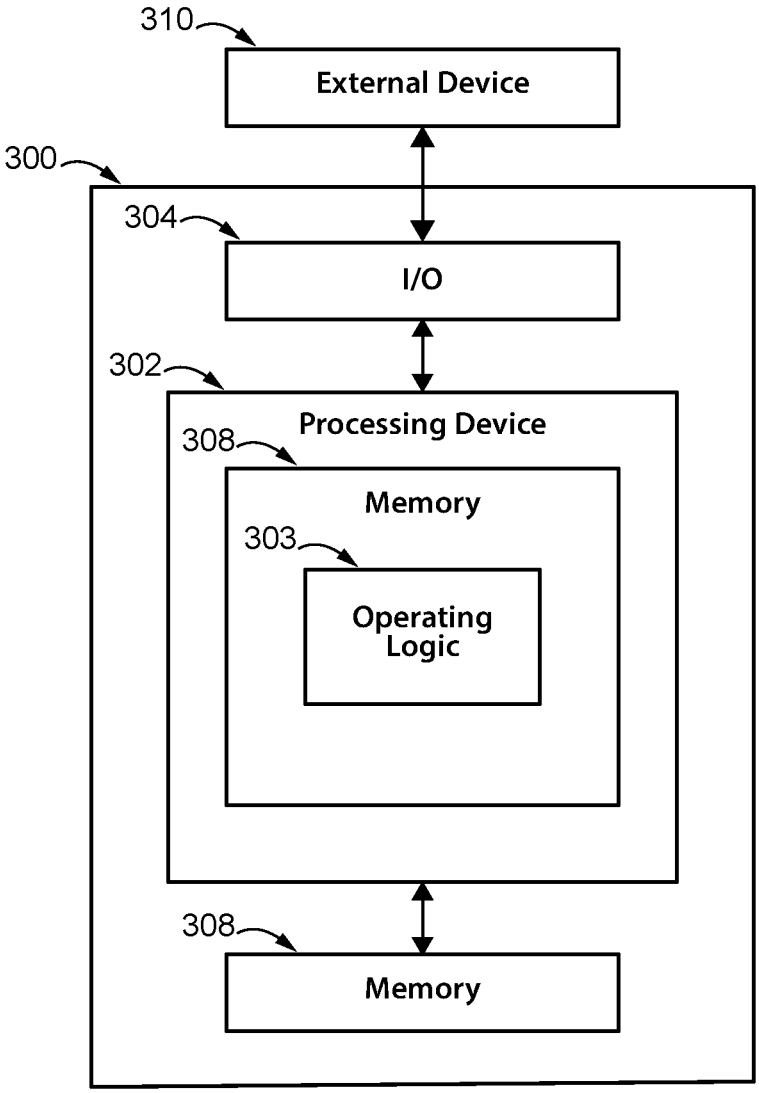
FIG. 10 is a schematic block diagram of a computing device that may be utilized in connection with certain embodiments.

FIG. 10 is a schematic block diagram of a computing device 300. The computing device 300 is one example of a computer, server, mobile device, reader device, or equipment configuration which may be utilized in connection with the controller 116 and/or credential reader shown in FIGS. 1 and 2. The computing device 300 includes a processing device 302, an input/output device 304, memory 308, and operating logic 303. Furthermore, the computing device 300 communicates with one or more external devices 310.

The input/output device 304 allows the computing device 300 to communicate with the external device 310. For example, the input/output device 304 may be a network adapter, network card, interface, or a port (e.g., a USB port, serial port, parallel port, an analog port, a digital port, VGA, DVI, HDMI, FireWire, CAT 5, or any other type of port or interface). The input/output device 304 may be comprised of hardware, software, and/or firmware. It is contemplated that the input/output device 304 includes more than one of these adapters, cards, or ports.

The external device 310 may be any type of device that allows data to be inputted or outputted from the computing device 300. For example, the external device 310 may be a mobile device, a reader device, equipment, a handheld computer, a diagnostic tool, a controller, a computer, a server, a printer, a display, an alarm, an illuminated indicator such as a status indicator, a keyboard, a mouse, or a touch screen display. Furthermore, it is contemplated that the external device 310 may be integrated into the computing device 300. It is further contemplated that there may be more than one external device in communication with the computing device 300.

The processing device 302 can be of a programmable type, a dedicated, hardwired state machine, or a combination of these; and can further include multiple processors, Arithmetic-Logic Units (ALUs), Central Processing Units (CPUs), Digital Signal Processors (DSPs) or the like. For forms of processing device 302 with multiple processing units, distributed, pipelined, and/or parallel processing can be utilized as appropriate. The processing device 302 may be dedicated to performance of just the operations described herein or may be utilized in one or more additional applications. In the depicted form, the processing device 302 is of a programmable variety that executes algorithms and processes data in accordance with operating logic 303 as defined by programming instructions (such as software or firmware) stored in memory 308. Alternatively or additionally, the operating logic 303 for processing device 302 is at least partially defined by hardwired logic or other hardware. The processing device 302 can be comprised of one or more components of any type suitable to process the signals received from input/output device 304 or elsewhere, and provide desired output signals. Such components may include digital circuitry, analog circuitry, or a combination of both.

The memory 308 may be of one or more types, such as a solid-state variety, electromagnetic variety, optical variety, or a combination of these forms. Furthermore, the memory 308 can be volatile, nonvolatile, or a combination of these types, and some or all of memory 308 can be of a portable variety, such as a disk, tape, memory stick, cartridge, or the like. In addition, the memory 308 can store data that is manipulated by the operating logic 303 of the processing device 302, such as data representative of signals received from and/or sent to the input/output device 304 in addition to or in lieu of storing programming instructions defining the operating logic 303, just to name one example. As shown in FIG. 10, the memory 308 may be included with the processing device 302 and/or coupled to the processing device 302.

The processes in the present application may be implemented in the operating logic 308 as operations by software, hardware, artificial intelligence, fuzzy logic, or any combination thereof, or at least partially performed by a user or operator. In certain embodiments, units represent software elements as a computer program encoded on a non-transitory computer readable medium, controller 116 and/or credential reader 126 performs the described operations when executing the computer program.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lockset, comprising:

a first bolt assembly including a first bolt operable to extend and retract;

a second bolt assembly including a second bolt operable to extend and retract, wherein the first bolt assembly and the second bolt assembly are offset from one another in a lateral direction; and a drive assembly operable to retract the first bolt and the second bolt, the drive assembly comprising:

a first gear train including a first input gear and a first output gear, wherein the first output gear is operably coupled with the first bolt assembly such that rotation of the first output gear in a first bolt retracting direction causes retraction of the first bolt;

a second gear train including a second input gear and a second output gear, wherein the second output gear is operably coupled with the second bolt assembly such that rotation of the second output gear in a second bolt retracting direction causes retraction of the second bolt;

a third input gear engaged with the first input gear and the second input gear; and an electromechanical driver operable to rotate the third input gear in an unlocking direction;

wherein the third input gear is engaged with the first input gear such that rotation of the third input gear in the unlocking direction causes the first gear train to rotate the first output gear in the first bolt retracting direction, thereby retracting the first bolt; and wherein the third input gear is engaged with the second input gear such that rotation of the third input gear in the unlocking direction causes the second gear train to rotate the second output gear in the second bolt retracting direction, thereby retracting the second bolt.

2. The lockset of claim 1, further comprising:

a first manual actuator operably coupled with the first bolt assembly and operable to retract the first bolt; and a second manual actuator operably coupled with the second bolt assembly and operable to retract the second bolt, wherein the second manual actuator is offset from the first manual actuator in the lateral direction.

3. The lockset of claim 2, wherein the first manual actuator is configured to rotate the first output gear as the first manual actuator retracts the first bolt.

4. The lockset of claim 3, wherein the first manual actuator is rotationally coupled with the first output gear.

5. The lockset of claim 3, wherein the third input gear is engaged with the first input gear via a first lost rotational motion connection such that rotation of the first input gear by the first manual actuator causes the first input gear to rotate relative to the third input gear without rotating the third input gear.

6. The lockset of claim 5, wherein the first input gear is coaxial with the third input gear.

7. The lockset of claim 5, wherein the third input gear is engaged with the second input gear via a second lost rotational motion connection such that rotation of the second input gear by the second manual actuator causes the second input gear to rotate relative to the third input gear without rotating the third input gear.

8. The lockset of claim 7, wherein the first input gear and the second input gear are coaxial with the third input gear.

9. The lockset of claim 2, wherein the first manual actuator is mounted to the first output gear.

10. The lockset of claim 2, wherein the first gear train further comprises a third output gear, wherein the third output gear is offset from the first output gear in the lateral direction, and wherein the first manual actuator is operable to be mounted to the third output gear.

11. The lockset of claim 2, further comprising an inside assembly configured to be mounted to an interior side of a door;

wherein the inside assembly includes an inside escutcheon, the first manual actuator, the second manual actuator, and the drive assembly;

wherein the first manual actuator is rotatably mounted to the inside escutcheon;

wherein the second manual actuator is rotatably mounted to the inside escutcheon; and wherein the drive assembly is housed within the inside escutcheon.

12. The lockset of claim 11, wherein the inside assembly further comprises a controller in communication with the electromechanical driver;

wherein the controller is configured to receive credential information from a credential reader, to determine whether the credential information corresponds to an authorized credential, and to actuate the electromechanical driver in response to determining that the credential information corresponds to the authorized credential.

13. The lockset of claim 12, further comprising an outside assembly including an outside escutcheon, a lock cylinder mounted to the outside escutcheon, an outside handle mounted to the outside escutcheon, and the credential reader;

wherein the lock cylinder is operably connected with the first bolt assembly and is operable to retract the first bolt; and wherein the outside handle is operably connected with the second bolt assembly and is operable to retract the second bolt.

14. A lock control module, comprising:

a housing assembly including a first case member and a second case member coupled with the first case member such that a cavity is formed therebetween, wherein the housing assembly defines a first opening and a second opening, wherein each of the first opening and the second opening extends through each of the first case member and the second case member;

an energy storage device housing operable to receive an energy storage device;

a drive assembly mounted within the cavity, the drive assembly comprising:

a first gear train including a first input gear and a first output gear, the first output gear including a first engagement feature aligned with the first opening;

a second gear train including a second input gear and a second output gear, the second output gear including a second engagement feature aligned with the second opening;

a third input gear engaged with the first input gear and the second input gear, wherein the third input gear is coaxial with the first input gear and the second input gear; and a driver operable to rotate the third input gear in each of an unlocking rotational direction and a locking rotational direction;

wherein the third input gear is engaged with the first input gear via a first lost motion connection, wherein the first lost motion connection is configured to cause the first input gear to rotate in response to rotation of the third input gear in the unlocking direction, and wherein the first lost motion connection is configured to permit the first input gear to rotate in the unlocking direction without causing a corresponding rotation of the third input gear; and wherein the third input gear is engaged with the second input gear such that rotation of the third input gear in the unlocking direction causes a corresponding rotation of the second input gear; and a controller mounted within the cavity, wherein the controller is electrically connected with the energy storage device housing such that the controller is operable to receive electrical energy from the energy storage device, and wherein the controller is electrically connected with the driver such that the controller is operable to actuate the driver.

15. The lock control module of claim 14, wherein the first lost motion connection comprises an aperture and a protrusion;

wherein the aperture is formed in one of the first input gear and the third input gear;

wherein the protrusion is formed on the other of the first input gear and the third input gear; and wherein the protrusion extends into the aperture.

16. The lock control module of claim 14, wherein the first opening is offset from the second opening in a lateral direction;

wherein the housing assembly further defines a third opening offset from the second opening in the lateral direction;

wherein the first gear train further comprises a third output gear including a third engagement feature corresponding to the first engagement feature; and wherein the third engagement feature is aligned with the third opening.

17. The lock control module of claim 16, wherein the first gear train is configured to rotate the first output gear in a first rotational direction in response to rotation of the first input gear in an unlocking direction, and wherein the first gear train is configured to rotate the third output gear in the first rotational direction in response to rotation of the first input gear in the unlocking direction.

18. The lock control module of claim 14, wherein the third input gear is engaged with the second input gear via a second lost motion connection, and wherein the second lost motion connection is configured to permit the second input gear to rotate in the unlocking direction without causing a corresponding rotation of the third input gear.

19. A lockset including the lock control module of claim 14, the lockset further comprising:

a deadbolt assembly including a deadbolt, wherein the deadbolt assembly is engaged with the first engagement feature via the first opening, and wherein the deadbolt assembly is configured to retract the deadbolt in response to rotation of the first output gear; and a latchbolt assembly including a latchbolt, wherein the latchbolt assembly is engaged with the second engagement feature via the second opening, and wherein the latchbolt assembly is configured to retract the latchbolt in response to rotation of the second output gear.

20. The lockset of claim 19, wherein the lock control module has a first orientation and an opposite second orientation relative to the lockset;

wherein with the lock control module in the first orientation, the deadbolt assembly is engaged with the first engagement feature via a portion of the first opening that is formed in the first case member, and the latchbolt assembly is engaged with the second engagement feature via a portion of the second opening that is formed in the first case member; and wherein with the lock control module in the second orientation, the deadbolt assembly is engaged with the first engagement feature via a portion of the first opening that is formed in the second case member, and the latchbolt assembly is engaged with the second engagement feature via a portion of the second opening that is formed in the second case member.

* * * * *